US012270160B2

(12) United States Patent
Buschmann et al.

(10) Patent No.: US 12,270,160 B2
(45) Date of Patent: Apr. 8, 2025

(54) CHANNEL PLATE ARRANGEMENT FOR A ROAD FINISHING MACHINE

(71) Applicant: JOSEPH VOEGELE AG, Ludwigshafen/Rhein (DE)

(72) Inventors: Martin Buschmann, Neustadt (DE); Frank Grimm, Edingen-Neckarhausen (DE); Bernhard Erdtmann, Mannheim (DE); Thomas Seither, Waldsee (DE); Alessandro De Santis, Lambsheim (DE); Nicole Angermann, Bruehl (DE); Christian Jenewein, Mannheim (DE)

(73) Assignee: Joseph Voegele AG, Ludwigshafen/Rhein (DE)

( * ) Notice: Subject to any disclaimer, the term of this patent is extended or adjusted under 35 U.S.C. 154(b) by 780 days.

(21) Appl. No.: 17/508,501

(22) Filed: Oct. 22, 2021

(65) Prior Publication Data

US 2022/0127800 A1 Apr. 28, 2022

(30) Foreign Application Priority Data

Oct. 22, 2020 (EP) ..... 20203308

(51) Int. Cl.
*E01C 19/48* (2006.01)

(52) U.S. Cl.
CPC ..... *E01C 19/48* (2013.01); *E01C 2301/16* (2013.01)

(58) Field of Classification Search
CPC ..... E01C 19/48; E01C 2301/16
See application file for complete search history.

(56) References Cited

U.S. PATENT DOCUMENTS

| | | | | |
|---|---|---|---|---|
| 3,541,934 | A | 11/1970 | Borgquist et al. | |
| 3,680,451 | A | 8/1972 | Birtchet | |
| 5,344,254 | A | 9/1994 | Sartain | |
| 5,484,227 | A * | 1/1996 | Ikeda | E01C 19/006 404/84.1 |
| 8,267,619 | B2 | 9/2012 | Munz | |
| 2010/0080655 | A1 * | 4/2010 | Munz | E01C 19/48 404/118 |

(Continued)

FOREIGN PATENT DOCUMENTS

| | | |
|---|---|---|
| CN | 217231376 U | 8/2022 |
| EP | 2 169 117 A1 | 3/2010 |

(Continued)

OTHER PUBLICATIONS

European Communication (with English Machine Translation) Dated Aug. 14, 2023, Application No. 20 203 308.0-1005, Applicant Joseph Vögele AG, 15 Pages.

(Continued)

*Primary Examiner* — Abigail A Risic
(74) *Attorney, Agent, or Firm* — Brooks Kushman P.C.

(57) ABSTRACT

A channel plate arrangement for a road finishing machine comprises an extension means including a first channel plate which is movably mounted in a horizontal direction with respect to the channel plate arrangement to variably adjust an effective width of the channel plate arrangement, and a second channel plate connected to the first channel plate. The second channel plate is arranged at the first channel plate in a pivoting manner to variably adjust the effective width of the channel plate arrangement.

20 Claims, 2 Drawing Sheets

(56) References Cited

U.S. PATENT DOCUMENTS

| | | | | |
|---|---|---|---|---|
| 2015/0337505 | A1* | 11/2015 | Stallgies | E01C 19/40 404/118 |
| 2022/0127800 | A1 | 4/2022 | Buschmann et al. | |
| 2022/0290381 | A1* | 9/2022 | Buschmann | E01C 19/176 |
| 2022/0389665 | A1* | 12/2022 | Pinson | E01C 19/48 |
| 2023/0243112 | A1* | 8/2023 | Angermann | E01C 19/4873 404/101 |

FOREIGN PATENT DOCUMENTS

| | | | |
|---|---|---|---|
| EP | 3 819 430 | A1 | 5/2020 |
| JP | S59 121004 | U | 8/1984 |
| JP | H1077799 | A | 3/1998 |
| JP | H1088515 | A | 4/1998 |
| JP | 2000 178916 | A | 6/2000 |
| JP | 2004300855 | A | 10/2004 |
| JP | 2010138559 | A | 6/2010 |
| WO | 2020/009123 | A1 | 1/2020 |
| WO | 2021/077149 | A1 | 4/2021 |

OTHER PUBLICATIONS

Chinese Search Report (with English Machine Translation) Dated Dec. 14, 2022, Application No. 202111237272.X, 4 Pages.
Chinese Office Action (with English Machine Translation) Dated Dec. 28, 2022, Application No. 202111237272.X, 13 Pages.
Japanese Office Action (with English Machine Translation) Dated Nov. 15, 2022, Application No. 2021-172310, 8 Pages.
European Search Report Dated Mar. 26, 2021, Application No. 20203308.0-1002—Applicant Joseph Voegele AG, 8 Pages.

* cited by examiner

CHANNEL PLATE ARRANGEMENT FOR A ROAD FINISHING MACHINE

CROSS-REFERENCE TO RELATED APPLICATIONS

This application claims foreign priority benefits under 35 U.S.C. § 119(a)-(d) to European patent application number EP 20203308.0, filed Oct. 22, 2020, which is incorporated by reference in its entirety.

TECHNICAL FIELD

The present disclosure relates to a channel plate arrangement for a road finishing machine, and a road finishing machine having such a channel plate arrangement.

BACKGROUND

Road finishing machines are sufficiently known from prior art. To increase their applicability, screeds variable with respect to their working widths have been designed. The working width is the width with which the screed spreads the material on the subsoil.

For example, EP 2 169 117 A1 discloses a corresponding screed whose working width is continuously variable.

Since by the adjustment of the working width of the screed, the width of the applied material also changes, an excessive application of material in front of the spreading screw can occur in the direction of travel of the road finishing machines that use the screed.

To avoid this, EP 2 169 117 A1 proposes installable channel plates which can be provided, for example, as part of the spreading screw suspension or connected thereto. While a possibility of adjusting the effective width of the channel plates is created thereby by which they prevent an undesired application of material in the direction of travel of the road finishing machine in front of the spreading screw, such a construction is time-consuming and not very flexible due to the channel plate parts to be installed.

Furthermore, WO2020/009123 A1 shows a road finishing machine, wherein the application of material in the direction of travel of the road finishing machine can be controlled by a pivoting outer mounting plate. The mounting plate is connected to the towing vehicle by comparably complex mechanical couplings.

SUMMARY

Starting from the known prior art, a technical object to be achieved is to design the effective width of the channel plate arrangement to be adaptable to the working width of a screed in a manner easy for the operator, wherein the disclosure should preferably also be able to be integrated into already existing road finishing machines.

This object is achieved by a channel plate arrangement according to the disclosure for a road finishing machine, or by a road finishing machine according to the disclosure comprising a material bunker, a spreading screw, a screed, and a channel plate arrangement.

The channel plate arrangement according to the disclosure comprises an extension means comprising a first channel plate mounted to be movable in the horizontal direction with respect to the channel plate arrangement to variably adjust the effective width of the channel plate arrangement, and wherein a second channel plate is connected to the first channel plate, and the second channel plate is arranged at the first channel plate in a pivoting manner to variably adjust the effective width of the channel plate arrangement.

The first channel plate can in particular be mounted movable transversely to a direction of travel of the road finishing machine.

The second channel plate can in particular be arranged at the first channel plate to be pivoting about an axis, wherein the axis can be, for example, a vertical axis or a horizontal axis.

With respect to its effective width, namely the width by which it can limit the material flow in the direction of travel, the channel plate arrangement can be adjusted to the working width of a screed, in particular a screed with a variable working width, with little efforts for the operator.

The working width of the screed is to be understood as the width by which the screed applies the material onto the subsoil or the foundation, respectively.

The effective width of the channel plate arrangement is understood as the width to which the channel plate arrangements limit the material flow in the direction of travel. This limitation can usually also be caused in interaction with lateral limiting plates of a screed between which the channel plate arrangement extends. Here, this limitation does not have to be perpendicular to the working direction of the road finishing machine, but can in particular be effected by the second channel plate, also partially obliquely or at a non-perpendicular angle.

The variable adjustability of the working width of the screed can mean a continuously variable adjustability, or also an adjustability of the working width variable in steps.

Basically, two types of screeds are known here and can be employed as the screed within the scope of the disclosure.

On the one hand, the extendable screed is known which comprises a basic screed (also referred to as basic screed body) and extendable screed parts arranged thereon. The extendable screed parts can usually be moved hydraulically (and continuously) with respect to the basic screed body. At the outer ends of the extendable screed parts, (rigid) broadening parts can be attached, as required. One or more of such broadening parts can be attached to the extendable screed parts to thus increase the working width of the extendable screed.

On the other hand, rigid screeds are known which comprise a rigid basic screed and broadening parts attachable to the basic screed. The broadening parts are usually rigid themselves. At the outer ends of the rigid screed, however, hydraulically adjustable extendable add-on parts can be arranged as a special embodiment of the broadening parts to thus be able to adjust the working width of the rigid screed continuously and variably at least at the outer ends. The extendable add-on parts are usually always provided as broadening parts arranged at the outermost location (seen from the center of the rigid screed).

The channel plate arrangement according to the disclosure on the one hand permits an essentially continuously variable adjustment of the effective width of the channel plate arrangement, and on the other hand, due both to the horizontal moving direction of the first channel plate and the pivoting movement of the second channel plate, a variable adjustment of the properties of the channel plate arrangement which in particular proves to be advantageous by the increased variable width of the channel plate arrangement.

In one embodiment, the extension means comprises an active, in particular hydraulic and/or pneumatic, moving means by which the first channel plate is movable in the horizontal direction. The hydraulic moving means permits an automatic, and thus for the operator preferably simple, movement of the first channel plate in the horizontal direction. The active moving means can in particular be designed as an actuator. The active moving means can in particular be designed to cause the horizontal movement of the first channel plate without any manual action, for example depending on a working width of the screed.

Furthermore, the extension means can be releasably connected to the channel plate arrangement.

This means that the remaining channel plate arrangement (also channel plate basic arrangement), which can in particular be designed as formerly common channel plate arrangement, can also be operated without the extension means. Thereby, narrow paths can be better passed by the road finishing machine by at least temporarily removing the extension means and reinstalling it again later, thus improving the applicability of the road finishing machine even in difficult terrain.

In one embodiment, the extension means is arranged at the channel plate arrangement by means of a guiding means, wherein the guiding means is designed to adjust a position of the extension means relative to the channel plate arrangement. Thereby, the adjustment of the effective width of the channel plate arrangement can be realized over a larger range since the extension means can also be shifted, which can move the starting positions for the horizontal movement of the first channel plate, for example, further away from the center of the channel plate arrangement.

Furthermore, the channel plate arrangement can have at least two suspensions arranged spaced apart from each other for a releasable connection with the extension means which are arranged, in an installed state of the channel plate arrangement, in a road finishing machine in a direction transverse to the working direction of the road finishing machine. By adapting the suspension point of the extension means, one can also achieve that the effective width of the channel plate arrangement can be increased. This and the preceding embodiment can also be advantageously combined to cause, on the one hand, a stepwise adjustment of the suspension and thus the starting position of the extension means, and on the other hand cause a continuously variable adjustment of the starting position of the extension means between these steps.

The second channel plate can also be arranged at the first channel plate in a pivoting manner by means of an active, in particular hydraulic, electric and/or pneumatic, pivoting means. This pivoting means can in particular also be designed as an actuator or comprise the same. The hydraulic pivoting permits the operator to perform a simple change of the effective width of the channel plate arrangement.

In a preferred embodiment, the active moving means and the active pivoting means can be coupled to cause both a movement of the first channel plate and a pivoting of the second channel plate simultaneously or synchronously, respectively.

In particular, the moving means and/or the pivoting means can cause the pivoting and/or moving depending on the working width of the screed partially automatically or all-automatically. To this end, for example, one or more sensors, such as distance sensors or positioning sensors, can be provided and determine information on the working width of the screed (for example taking into consideration rigid broadening parts and/or movable extendable add-on parts and/or movable extendable screed parts). Based on these information, a control unit can then activate the pivoting means and/or the moving means for a (synchronous) movement (i.e., pivoting and/or moving) of the first and/or the second channel plate.

In one embodiment, the second channel plate is mounted to be pivoting from a starting position in which it is arranged, for example, in parallel to the first channel plate, in the direction of the working direction of a road finishing machine and/or against the working direction of the road finishing machine. This means that the second channel plate is pivoting in the working direction either to the front or to the back, which can be advantageous depending on the application of the road finishing machine. The starting position is here only arbitrarily stated to be parallel to the first channel plate. Any other starting position is here also conceivable, wherein, starting from this starting position, a pivoting into at least one direction, either in the working direction and/or against the working direction, is possible according to this embodiment.

Furthermore, the channel plate arrangement can have an effective basic width. According to this embodiment, the channel plate arrangement will prevent an undesired placement of the laying material on the subsoil or the foundation, respectively, in the working direction over a certain width even without extension means (then in the sense of a channel plate basic arrangement).

In one embodiment, the extension means comprises a third channel plate whose position with respect to the extension means is fixed.

Thereby, the extension means already limits an application of the material independent of the relative position of the first and second channel plates. This can in particular be advantageous with respect to the embodiments of the variable arrangement of the extension means at the channel plate arrangement to avoid gaps in the overall channel plate arrangement (then also comprising the extension means).

In a further embodiment, the extension means is designed for a coupled movement with a screed of a road finishing machine, so that the effective width of the channel plate arrangement is adjustable in response to a working width of a screed. Thereby, by adjusting the working width of the screed, a correct adjustment of the effective width of the channel plate arrangement can already be realized. This can be realized, for example, via the sensors and control unit already mentioned above. The coupling of the movement of the channel plate arrangement to the movement or working width of the screed can here comprise a mechanical coupling and/or a control-related coupling, for example via a control loop using one or a plurality of sensors.

The position of the first channel plate may be adjustable independent of the pivoting of the second channel plate. Different requirements on the channel plate arrangement and its effective width can thus be realized.

The position of the first channel plate may be adjustable independent of the pivoting of the second channel plate.

The road finishing machine according to the disclosure comprises a tow car, a material bunker, a spreading screw, and a screed as well as a channel plate arrangement according to one of the preceding embodiments. This road finishing machine permits an adjustment of the working width and the effective width of the screed or the channel plate arrangement, respectively, which is facilitated for the operator.

The road finishing machine comprises, according to one embodiment, a control unit for controlling the effective width of the channel plate arrangement in response to the working width of the screed. Thereby, an (all-) automatic adjustment of the effective width of the channel plate arrangement and the working width of the screed can be ensured, thus further facilitating the operation of the road finishing machine for its operator.

DETAILED DESCRIPTION

Figure 1:
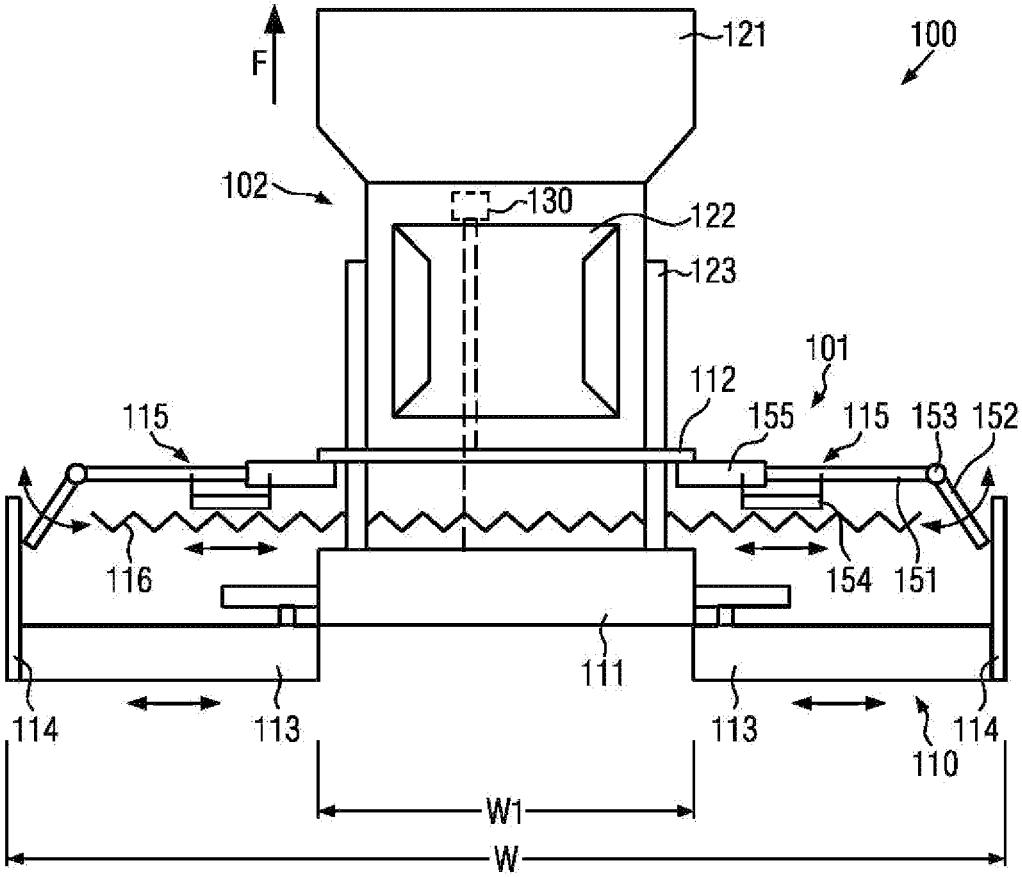
FIG. 1 shows a schematic plan view onto a road finishing machine with a screed and a channel plate arrangement according to one embodiment of the disclosure.

FIG. 1 shows an inventive road finishing machine 100 according to one embodiment of the disclosure.

The road finishing machine usually comprises a tow car 102 and a screed 110 attached to the tow car, and a spreading screw 116. The embodiment of the towing vehicle or tow car 102 is only to be understood by way of example. The screed can rather be used with any suited towing vehicles or tow cars employed in the finishing of roads.

In the exemplary embodiment, the towing vehicle 102 comprises a material bunker 121 in which the material to be applied to the subsoil, for example asphalt, is stored. A transport system not represented here in greater detail, optionally with one or more scraper belts, can transport the material from the material bunker 121 through the towing vehicle towards the screed 110 where it is spread by the spreading screw transverse to the direction of travel and in front of the screed.

The towing vehicle 102 can furthermore comprise a driver's cabin 122 in which a driver can take seat. Here, automatic embodiments or autonomously driving embodiments are also conceivable. These then do not necessarily have to comprise a driver's cabin 122.

Laterally at the towing vehicle 102, bars or cylinders 123 can be arranged each and connect the screed 110 with the towing vehicle and coordinate them, for example with respect to height. They can also only serve for "towing" the screed over the subsoil and otherwise do not have any further function.

The screed comprises, according to the embodiment represented in FIG. 1, at least one "basic screed" 111. The latter has a certain working width W1 which is here not specified in greater detail. It can be, for example, 1 m, 2 m, or 3 m. In a particularly preferred manner, the screed has altogether a variably adjustable working width.

The following description assumes, for the sake of simplicity, that the screed is an extendable screed in the sense of the above statements. That means, it comprises extendable screed parts connected to a basic screed body and movable with respect to it, preferably in a hydraulic manner. It will be understood that the disclosure is not limited to an extendable screed as a screed, an embodiment of the screed by means of a rigid screed is rather also possible. That means, while below, an embodiment of the screed as an extendable screed will be discussed, the design of this screed as a rigid screed with optional broadening parts and hydraulically adjustable extendable add-on parts is also comprised at all times.

To this end, in the embodiment represented here, extendable screed parts 113 are provided. These can be moved relative to the basic screed 111 in the direction of the double arrow represented here to thus change the working width of the screed.

In the process, the working width W can be defined, for example, by the overall width of the basic screed 111 together with the extendable screed parts 113. The region in which the material is spread, for example by the spreading screw 116, in front of the basic screed and the extendable screed parts is usually limited by lateral shields 114 which prevent a spreading of the material to be laid in regions outside the screed.

The basic screed 111 and the extendable screed parts 113 as well as the shields 114 are basically known and perform the functions known from prior art.

The extendable screed parts 113 can (but do not have to) be adjustable hydraulically relative to the basic screed 111 to adjust the working width W of the screed. As an alternative, the extendable screed parts can be provided as manually adjustable or manually attachable and removable additional parts connected to the basic screed 111 as required.

In case of a rigid screed, (rigid) broadening parts can also be provided as a part of the screed beyond the basic screed 111, which can be connected to the basic screed. In such a case, hydraulically adjustable extendable add-on parts are arranged at the outer end of the broadening parts seen from the basic screed.

The disclosure is not restricted with respect to these embodiments.

According to the disclosure, a channel plate arrangement 101 is provided as part of the road finishing machine 100 represented herein.

This channel plate arrangement 101 is located, in an attached state of the channel plate arrangement and the screed in the road finishing machine, on the side of the spreading screw 116 opposite with respect to the screed 110 (possibly with the basic screed 111 and the extendable screed parts 113 as well as optionally screed broadening parts). In particular, it is located in front of the side of the spreading screw 116 in the direction of travel F.

The channel plate arrangement 101 has the function of not permitting the material spread on the subsoil by the spreading screw 116 to escape beyond the channel plate arrangement 101 in the direction of travel, which can effectively prevent an unintentional cooling of the material on the one hand, but also a damaging of the road finishing machine 100 on the other hand. Moreover, one can thus provide a continuous material flow in front of the spreading screw, and furthermore a thermal and/or mechanical segregation of the material of the material flow can be prevented.

Since the working width of the screed is defined by the basic screed 111 (and optionally provided screed broadening parts), in one embodiment, the channel plate arrangement 101 can have an "effective basic width" which, for example, approximately corresponds to the working width corresponding to the basic screed or the basic screed body 111. The effective width of the channel plate arrangement 101 is the width by which it is basically able to prevent the escape of material towards the towing vehicle. The effective basic width can be realized, for example, analogously to the basic screed 111 by a channel plate basic arrangement 112.

To this end, the channel plate arrangement 101 can comprise one or more channel plates which can be firmly connected, for example, with the screed and/or a screw crosshead of the spreading screw and/or a chassis, for example by screwed or welded joints.

According to the disclosure, the channel plate arrangement furthermore comprises an extension means 115 which is embodied to variably adjust the effective width of the channel plate arrangement 101 (preferably in response to the working width of the screed). To this end, the extension means 115 comprises, according to one embodiment, at least one first channel plate 151 which can be shifted, in the image plane represented here, horizontally in the direction of the double arrow also represented here by means of, for example, a hydraulic moving means 154 (for example a hydraulic cylinder).

Thereby, the effective width of the channel plate arrangement 101 is enlarged when the first channel plate is shifted further to the outside.

It is furthermore provided according to the disclosure that at the external end of the channel plate 151, a second channel plate 152 is arranged, for example via a hydraulic pivoting means. The latter is arranged to be pivoting about the axis 153 according to the disclosure, wherein the exact position of the axis is not to be understood as limiting. For example, the axis 153 here extends perpendicularly to the plane of projection, so that the channel plate 152 is pivoted in the plane of projection. Other embodiments where the axis 153 is located in the plane of projection or includes an angle with the plane of projection different from 90° are also conceivable.

The second channel plate 152 represented here is pivoting against the direction of travel F. However, the second channel plate 152 may also be pivoting, starting from a starting position (for example, a position corresponding to the first channel plate 151), about the axis 153 in the direction of travel F. Moreover, embodiments are conceivable wherein the second channel plate 152 can be arbitrarily pivoted along or about the axis 153, respectively.

The extension means 115 can in one embodiment only comprise the first channel plate 151 and the second channel plate 152 as well as corresponding means for moving the first channel plate along a horizontal direction and means for moving or pivoting the second channel plate about the axis 153 (pivoting means 153), and be directly connected to the channel plate arrangement, for example by the hydraulic cylinder being fixed to the channel plate arrangement, so that an actuation of the hydraulic cylinder causes a movement of the first channel plate relative to the remaining channel plate arrangement.

As an alternative, the extension means may also comprise one or more further channel plates 155, which are then, however, preferably embodied to be immobile with respect to the channel plate basic arrangement 112. These then form a fixed reference point, for example, for the movement of the first channel plate 151 and the pivoting of the second channel plate 152. Moreover, by the use of such an additional third channel plate or further channel plates it can be ensured that in the installation of the extension means, the means for actuating the first and second channel plates not also have to be adapted to the already existing channel plate basic arrangement.

In the embodiment of the road finishing machine 100 represented in FIG. 1, a control unit 130 in the towing vehicle 102 is furthermore schematically shown. This control unit can be embodied in one embodiment such that it controls, for example, the activation of the extendable screed parts 113 and/or the extension means 115 of the channel plate arrangement 101. By this, an at least partially automatic or all-automatic movement of the extendable screed parts 113 and/or the extension means 115 can be realized, and the operator does not have to adjust the channel plates manually.

While the control unit 130 is provided as part of the towing vehicle in the embodiment represented here, the control unit can be, in other embodiments, also be provided as part of the screed 110. Moreover, alternative embodiments are conceivable, wherein one part of the control unit is arranged in the screed, and another part of the control unit is arranged in the towing vehicle 102.

The control unit can be embodied, for example, as a control computer for the screed 110 and/or all functions of the towing vehicle 102, and have, for example, an input option, such as a keyboard, and an output option, such as a display.

Moreover, sensors can be associated with the control unit and automatically determine, for example, the width of the screed and cooperate by means of the extension means and/or the pivoting means 153, and/or the moving means 154 in the sense of a control loop, so that the effective width of the channel plate arrangement is adjusted in response to the working width of the screed. This can be preferably done all-automatically, so that, for example during the operation of the road finishing machine when a gully and/or a (bridge) pier is reached, the working width of the screed and, based thereon and preferably synchronously, the effective width of the channel plate arrangement is adjusted to avoid a collision or an undesired application of material.

Figure 2:
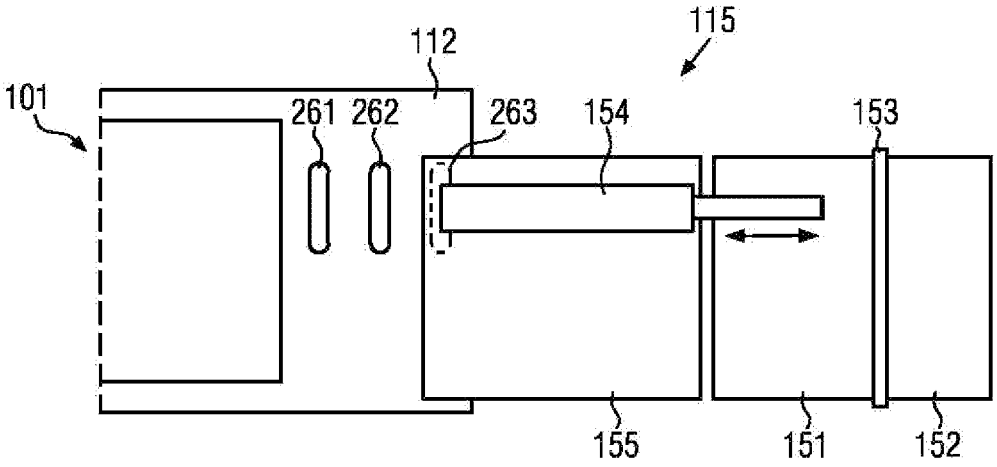
FIG. 2 shows a view of the channel plate arrangement with an extension means according to one embodiment.

FIG. 2 shows an embodiment of a channel plate arrangement 101.

In the embodiment represented here, the channel plate arrangement 101 comprises the channel plate basic arrangement 112 which comprises a number of suspensions 261, 262, and 263, which are each embodied to receive an extension means and thus connect it removably with the channel plate basic arrangement or the remaining channel plate arrangement.

The suspensions provided here are represented as individual slots or elongated holes. They can also be pairs of elongated holes which are, for example, offset with respect to each other in the vertical direction. Other embodiments instead of elongated holes, for example, threaded holes or openings or clamping means, are also conceivable here.

Basically, the suspensions 261 to 263 only have to be designed such that they permit a releasable connection of the extension means 115 with the channel plate basic arrangement 112.

If the suspensions 261 to 263 are embodied, for example, as elongated holes, the extension means can comprise corresponding engagement provisions which can engage these elongated holes to form a (releasable) connection with the channel plate basic arrangement.

In the embodiment of FIG. 2 represented here, the extension means comprises, apart from the first channel plate 151 and the second channel plate 152, also the third channel plate 155 which has already been described with respect to FIG. 1. The hydraulic cylinder 154 is associated with or fixed to this channel plate by means of which the first channel plate 151 can be hydraulically moved.

Instead of the hydraulic cylinder 154, other realizations of a moving means for horizontally moving the first channel plate can also be provided. For example, pneumatic cylinders or combinations of them with hydraulic cylinders can be used.

Instead of the hydraulic moving means, a manual adjustment of the position of the first channel plate in the horizontal direction (represented double arrow) relative to the third channel plate 155 or in general relative to the channel plate basic arrangement 112 can be provided, for example by means of a crank and a spindle or similar means.

While here, a third channel plate at which the extension means is arranged is represented, more than a third channel plate in the sense of one or more channel plate broadening parts may be provided, for example comparable to the broadening parts of the screed, to determine the width of the channel plate arrangement. At the outermost channel plate broadening part starting from the channel plate basic arrangement, the extension means can then be arranged with the first channel plate and the second channel plate pivoting with respect to it. The channel plate broadening parts are preferably embodied to be rigidly connectable to the channel plate basic arrangement, for example by means of screwed joints.

If no third channel plate 155 is provided, the connection of the extension means with the channel plate basic arrangement in FIG. 2 may be, for example partially or completely, realized by means of the hydraulic cylinder 154 or more generally by an optionally provided (hydraulic) moving means which would then comprise, on the one hand, means for moving the first channel plate 151, and on the other hand, means for connecting it with the channel plate basic arrangement 112.

Figure 3:
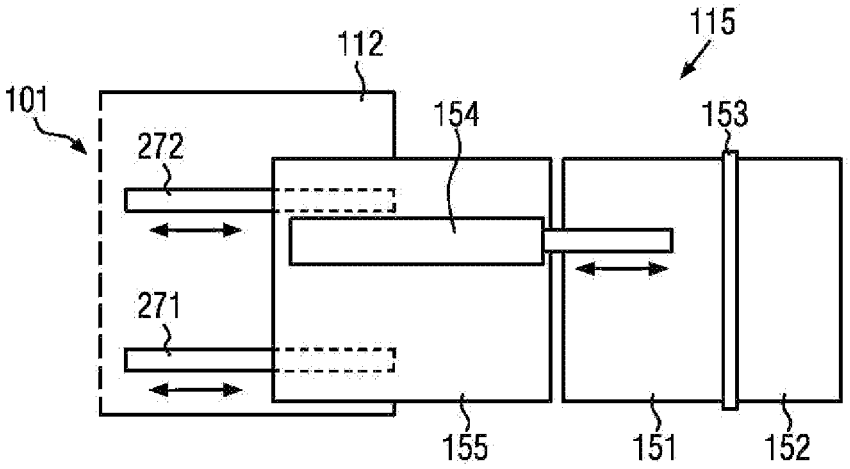
FIG. 3 shows a further view of a channel plate arrangement with extension means according to a second embodiment.

In the embodiment represented in FIG. 3, instead of the suspensions 261 to 263, two guiding means 271 and 272 are provided which can be embodied, for example, in the form of rails along which the extension means can be movably mounted. Instead of two guiding means 271 and 272, only one guiding means can also be provided. The guiding means permit a principally continuously variable adjustment of the horizontal position of the first channel plate 151 of the extension means 115, in contrast to the embodiment described in FIG. 2.

It is also conceivable to realize a combination of these embodiments described in FIG. 2 and FIG. 3, wherein, for example, connection means are provided which can be connected with the suspensions 261, 262 or 263, and to which then, on the other hand, the extension means is attached, wherein the connection means permit a horizontal movement or a horizontal shifting of the extension means relative to the suspensions in the channel plate basic arrangement 112.

Thereby, on the one hand, a stepwise adjustment of the "rough" distance of the extension means, for example towards the center of the screed, can be effected. On the other hand, then a continuously variable adjustment of the exact position of the extension means is also possible.

Here, the continuously variable adjustment of the position of the extension means may be possible in the horizontal direction preferably over a region which is at most equal to or at least slightly smaller than the distance of two adjacent suspensions. If the suspensions have, for example, a distance of 20 cm, the connection parts may permit a continuously variable adjustment of the position of the extension means relative to the channel plate basic arrangement 112 over 15 cm or over 18 cm. Here, any other values are also conceivable.

While in the embodiments represented in FIGS. 2 and 3, the third channel plate 155 has a small distance to the first channel plate, those embodiments are particularly preferred in which, independent of the adjusted position of the first plate 151 in the horizontal direction by means of the, for example, hydraulic moving means 154, an uninterrupted overlap between the third channel plate 155 (if provided) or the channel plate basic arrangement 112 and the first channel plate 151 is always ensured. For example, an unintentional escape of material from a gap that forms, for example, between the first channel plate and the third channel plate or the channel plate basic arrangement can be avoided. Simultaneously, by this overlap, the stability of the first channel plate can be increased if it extends, in the direction of travel, behind the third channel plate or the channel plate basic arrangement, respectively, so that it is pushed, due to the material pressure, from the spreading screw against the channel plate basic arrangement 112 or the third channel plate 155, respectively.

While the guiding means has been described in the former embodiments of FIG. 3 as separate means for moving or adjusting the position of the extension means relative to the channel plate basic arrangement, the guiding means can also be used to permit a shifting of the extension means between two adjacent suspensions in a preferably easy manner for the operator.

While in FIGS. 2 and 3 and also with respect to FIG. 1, reference was only made to one extension means 115, it will be appreciated that a corresponding extension means 115 can be arranged on both sides of the channel plate basic arrangement 112. Here, asymmetric embodiments of the screed are also possible, so that, as required, an extension means is only provided on one side of the channel plate basic arrangement, and on the other side, only the channel plate basic arrangement determines the effective width of the channel plate arrangement.

It will be appreciated that the channel plate arrangement can be provided independent of the screed employed. The use of the channel plate arrangement is particularly advantageous in particular in combination with a screed with a variable working width (in particular extendable screeds), however, the channel plate arrangement with the extension means can also be fixed to a road finishing machine and be adapted to the working widths of different screeds not adjustable with respect to their working widths.

While basically the enlargement of the working width W of the screed 110 by shifting already described extendable screed parts 113 and the broadening of the effective width of the channel plate arrangement 101 may be independently possible, here, not only a control-related coupling (for example, via the control unit 130), but also a mechanical coupling between the adjustment of the working width of the screed and the effective width of the channel plate arrangement can be provided. The mechanical coupling can be realized, for example, by a(n) (at least partially) rigid connection of an extendable screed part with the extension means. The control-related coupling can, for example, be done by means of one or more sensors which measure the working width of this screed and transmit it to the control unit, and an actuation of the pivoting means and/or the moving means by the control unit depending on the working width of the screed determined by the sensors, such that the effective width of the channel plate arrangement is adjusted depending on the working width of the screed.

In particular if the width of the channel plate arrangement or the horizontal position of the first channel plate is continuously variable, via a mechanical connection of the moving means for moving the first channel plate with an element of the extendable screed parts, the movement of the extendable screed parts may be transferred into a movement of the first channel plate and/or the complete extension arrangement and/or a pivoting of the second channel plate.

What is claimed is:

1. A channel plate arrangement for a road finishing machine, the channel plate arrangement comprising an extension means including a first channel plate which is movably mountable in a horizontal direction with respect to the channel plate arrangement to variably adjust an effective width of the channel plate arrangement, and a second channel plate connected to the first channel plate, wherein the second channel plate is arranged at the first channel plate in a pivotable manner to variably adjust the effective width of the channel plate arrangement, and wherein the channel plate arrangement comprises at least two suspensions aged to be spaced apart from each other for a releasable connection with the extension means which are, in an installed state of the channel plate arrangement in the road finishing machine, configured to be arranged in a direction verse to a working direction of the road finishing machine.

2. The channel plate arrangement according to claim 1, wherein the extension means comprises an active moving means by which the first channel plate is movable in the horizontal direction.

3. The channel plate arrangement according to claim 2, wherein the active moving means comprises hydraulic, electric and/or pneumatic moving means.

4. The channel plate arrangement according to claim 2, wherein the active moving means comprises a cylinder.

5. The channel plate arrangement according to claim 1, wherein the extension means is releasably connected to a portion of the channel plate arrangement.

6. The channel plate arrangement according to claim 1, wherein the extension means is arranged at a portion of the channel plate arrangement by means of a guiding means, wherein the guiding means is embodied for adjusting a position of the extension means relative to the portion of the channel plate arrangement.

7. The channel plate arrangement according to claim 1, wherein the second channel plate is arranged to be pivotable by an active pivoting means at the first channel plate.

8. The channel plate arrangement according to claim 7, wherein the active pivoting means comprises hydraulic and/or pneumatic pivoting means.

9. The channel plate arrangement according to claim 1, wherein the second channel plate is mounted to be pivotable from a starting position, in which the second channel plate is arranged in parallel to the first channel plate, in an installed state in the road finishing machine in a direction of a working direction of the road finishing machine and/or against the working direction of the road finishing machine.

10. The channel plate arrangement according to claim 1, wherein the channel plate arrangement has an effective basic width.

11. The channel plate arrangement according to claim 1, wherein the extension means comprises a third channel plate, wherein the first channel plate is positioned between the second channel plate and the third channel plate, and the first channel plate is movable with respect to the third channel plate.

12. The channel plate arrangement according to claim 1, wherein the extension means is embodied for a coupled movement with a screed of the road finishing machine, so that the effective width of the channel plate arrangement is adjustable in response to a working width of the screed.

13. The channel plate arrangement according to claim 1, wherein position of the first channel plate is adjustable independent of pivoting of the second channel plate.

14. A road finishing machine, comprising a tow car, a material bunker, a spreading screw, a screed, and the channel plate arrangement according claim 1.

15. The road finishing machine according to claim 14, further comprising a control unit for controlling the effective width of the channel plate arrangement in response to a working width of the screed.

16. A channel plate arrangement for a road finishing machine, the channel plate arrangement comprising:

a first channel plate which is movably mountable on the road finishing machine so that the first channel plate is movable in a horizontal direction to variably adjust an effective width of the channel plate arrangement;

a second channel plate connectable to the first channel plate and configured to pivot with respect to the first channel plate to variably adjust the effective width of the channel plate arrangement, and at least two suspensions spaced apart from each other and configured to provide a releasable connection for the first channel plate which is, in an installed state of the channel plate arrangement on the road finishing machine, configured to be arranged in a direction transverse to a working direction of the road finishing machine.

17. A road finishing machine comprising:

a screed; and the channel plate arrangement according to claim 16 arranged in front of the screed with respect to the working direction of the road finishing machine.

18. The road finishing machine according to claim 17, wherein the second channel plate is connected to the first channel plate so that the second is pivotable in the working direction or against the working direction.

19. The road finishing machine according to claim 18, wherein the channel plate arrangement includes an actuator configured to move the first channel plate in the horizontal direction, and an additional actuator configured to pivot the second channel plate with respect to the first channel plate.

20. The channel plate arrangement according to claim 16, further comprising at least one additional channel plate that is connectable to the at least two suspensions, wherein the first channel plate is connected to the at least one additional channel plate so that the first channel plate is positioned between the second channel plate and the at least one additional channel plate.

* * * * *